US009089846B2

(12) United States Patent
Ishikawa et al.

(10) Patent No.: US 9,089,846 B2
(45) Date of Patent: Jul. 28, 2015

(54) MEDIA-AGITATION TYPE PULVERIZER

(75) Inventors: Tsuyoshi Ishikawa, Narashino (JP); Shogo Iwasawa, Narashino (JP); Takahiro Tamura, Narashino (JP)

(73) Assignee: ASHIZAWA FINETECH LTD., Narashino-shi, Chiba (JP)

( * ) Notice: Subject to any disclaimer, the term of this patent is extended or adjusted under 35 U.S.C. 154(b) by 36 days.

(21) Appl. No.: 14/122,711

(22) PCT Filed: Jul. 23, 2012

(86) PCT No.: PCT/JP2012/068567

§ 371 (c)(1),
(2), (4) Date: Nov. 27, 2013

(87) PCT Pub. No.: WO2013/015237

PCT Pub. Date: Jan. 31, 2013

(65) Prior Publication Data

US 2014/0091165 A1 Apr. 3, 2014

(30) Foreign Application Priority Data

Jul. 28, 2011 (JP) ..... 2011-165005
May 24, 2012 (JP) ..... 2012-118462
Jun. 5, 2012 (JP) ..... 2012-127637

(51) Int. Cl.
*B02C 17/16* (2006.01)
*B02C 17/18* (2006.01)

(52) U.S. Cl.
CPC ..... *B02C 17/1815* (2013.01); *B02C 17/161* (2013.01); *B02C 17/168* (2013.01); *B02C 17/18* (2013.01); *B02C 17/184* (2013.01); *B02C 17/16* (2013.01)

(58) Field of Classification Search
CPC ..... B02C 17/00; B02C 17/16; B02C 17/161; B02C 17/183; B02C 17/184
USPC ..... 241/171–172, 79, 79.2
See application file for complete search history.

(56) References Cited

U.S. PATENT DOCUMENTS 5,346,147 A 9/1994 Ishikawa et al.
5,566,896 A * 10/1996 Stehr et al. ..... 241/171

(Continued)

FOREIGN PATENT DOCUMENTS

JP 10-118511 5/1998
JP 2005-199125 7/2005

OTHER PUBLICATIONS

International Preliminary Report (PCT/JP2012/068567) (6 pages—dated Jul. 23, 2012).

*Primary Examiner* — Faye Francis
(74) *Attorney, Agent, or Firm* — Renner, Kenner, Grieve, Bobak, Taylor & Weber

(57) ABSTRACT

A media-agitation pulverizer is capable of creating a uniformized, stable helicoidal flow in a mixture of pulverizing media and a raw material slurry, thereby performing pulverization/dispersion uniformly with satisfactory energy efficiency. The media-agitation pulverizer includes a guide ring installed to radially divide a lower region of a pulverization chamber into an inner section and an annular outer section, whereby a flow of a mixture of a raw material slurry and pulverizing media is formed as a helicoidal flow including a secondary flow flowing through a circulation flow path with respect to the guide ring; and rotational-flow suppressing device is provided within the pulverization chamber and adapted to strengthen the secondary flow of the helicoidal flow, thereby stabilizing the helicoidal flow.

17 Claims, 8 Drawing Sheets

(56) References Cited

U.S. PATENT DOCUMENTS 5,791,569 A * 8/1998 Ishikawa ..... 241/74
8,172,169 B2 * 5/2012 Ishikawa ..... 241/171
2005/0224612 A1 * 10/2005 Heinzelmann et al. ..... 241/172
2010/0270408 A1 10/2010 Ishikawa

* cited by examiner

A－A

B—B

MEDIA-AGITATION TYPE PULVERIZER

TECHNICAL FIELD

The present invention relates to a media-agitation type pulverizer. The media-agitation type pulverizer of the present invention is particularly suitable for use in, but not limited to, mixing a raw material for ink, paint, pigment, ceramics, metal, inorganic material, dielectric material, ferrite, toner, glass, paper coating color or other nanoparticles, with pulverizing/dispersing media in the form of beads, to pulverize or disperse the raw material into fine particles.

BACKGROUND ART

As a media-agitation type pulverizer, there has been known a media-agitation (agitated media) mill proposed in JP 2005-199125 A.

The media-agitation mill proposed in the JP 2005-199125A comprises a pulverization tank including an end plate closing up an upper end thereof and internally having a pulverization chamber containing pulverizing media, a rotary shaft rotatably provided in the pulverization tank, and an agitating/separating member provided on a portion of the rotary shaft located inside the pulverization chamber and adapted to be rotatable integrally with the rotary shaft. This media-agitation mill is characterized in that an inner wall surface of the pulverization chamber and an outer peripheral surface of the agitating/separating member are formed in shapes conforming to each other, wherein the media-agitation mill further comprises a separation/discharge passage extending from the outer peripheral surface to penetrate through a central portion of the agitating/separating member and then extending from the central portion of the agitating/separating member to penetrate through a central portion of the rotary shaft and communicate with an outside of the pulverization chamber, and a pressure relief hole penetrating between upper and lower surfaces of the agitating/separating member in an axial direction of the rotary shaft to provide communication between upper and lower regions of an inside of the pulverization chamber.

However, in the media-agitation mill having the above structure, the pulverizing media are liable to be concentrated around a maximum-diameter portion where a centrifugal force is maximized, i.e., to be localized in a specific position, so that a dispersion or pulverization force varies with position, and the variation is large. Thus, there is a problem that a raw material is not uniformly dispersed or pulverized, causing difficulty in obtaining a high-quality product.

Therefore, the applicant of this application proposed a media-agitation type pulverizer capable of obtaining a high-quality product by a good pulverizing/dispersing action, in JP 2009-103529 (JP 2010-253339A).

The media-agitation type pulverizer proposed in the JP 2009-103529 comprises: a pulverization container having an upright cylindrical pulverization chamber containing pulverizing media in the form of beads; a raw-material-slurry supply port provided in the pulverization container; an agitating member disposed in a bottom region of the pulverization chamber and having a rotary shaft substantially coaxial with a central axis of the pulverization chamber; and a media separation member provided within the pulverization chamber and above the agitating member. This media-agitation type pulverizer is characterized in that it further comprises a guide ring installed to radially divide a lower region of the pulverization chamber into an inner section and an annular outer section, wherein an upward flow path of a mixture of the pulverizing media and the raw material slurry is created in the outer section of the lower region of the pulverization chamber.

In the media-agitation type pulverizer proposed in the JP 2009-103529, the guide ring is installed in the pulverization chamber, as mentioned above, whereby a flow of the mixture of the pulverizing media and the raw material slurry can be formed as a combined flow (i.e., helicoidal (spiral or helical) flow) consisting of a flow moving in a circumferential direction of the pulverization chamber (i.e., a primary flow) and a flow capable of regularly repeating a movement cycle of, after moving in a radially outward direction of the pulverization chamber toward an inner wall of the pulverization container, moving upwardly through the upward flow path between the guide ring and the pulverization container, and then moving downwardly from a central region of the pulverization chamber to return to the agitating member, via a space inward of the guide ring (i.e., a secondary flow). Thus, even if a volume ratio of beads to the pulverization chamber is relatively low, localization (uneven distribution) of the pulverization media can be suppressed to some extent to provide enhanced pulverization/dispersion efficiency.

However, the helicoidal flow formed by the media-agitation type pulverizer proposed in the JP 2009-103529 is unstable due to weakness and instability of the secondary flow thereof, so that centrifugal force distribution is likely to become uneven, which causes localization of the pulverization media in the helicoidal flow. Thus, there is a problem of non-uniform pulverization and not-so-satisfactory energy efficiency.

PRIOR ART DOCUMENTS

Patent Documents

Patent Document 1: JP 2005-199125A
Patent Document 2: JP 2010-253339A

DISCLOSURE OF THE INVENTION

Solution to the Technical Problem

It is therefore an object of the present invention to provide a media-agitation type pulverizer capable of creating a uniformized, stable helicoidal flow in a mixture of pulverizing media and a raw material slurry, without unevenness of a centrifugal force distribution, thereby performing pulverization/dispersion uniformly with satisfactory energy efficiency.

The above object is achieved by a media-agitation type pulverizer having the following features set forth in (1) to (17).

(1) A media-agitation type pulverizer comprising: a pulverization container including an end plate closing up an upper end thereof and having an upright cylindrical pulverization chamber containing pulverizing media in the form of beads; a raw-material-slurry supply port provided in the pulverization container; an agitating member disposed in a bottom region of the pulverization chamber and having a rotary shaft substantially coaxial with a central axis of the pulverization chamber; and a media separation member provided within the pulverization chamber and above the agitating member. The media-agitation type pulverizer is characterized in that it further comprises: a guide ring installed to radially divide a lower region of the pulverization chamber into an inner section and an annular outer section, whereby a flow of a mixture of the raw material slurry and the pulverizing media is formed as a helicoidal flow comprising a combination of a primary flow flowing in a circumferential direction of the pulverization chamber and a secondary flow flowing through a circulation flow path which has an upward flow path and a downward flow path created, respectively, in the outer section and the inner section of the lower region of the pulverization chamber, with respect to the guide ring; and rotational-flow suppressing means provided within the pulverization chamber and adapted to suppress the primary flow while strengthening the secondary flow, thereby stabilizing the helicoidal flow.

(2) In the media-agitation type pulverizer set forth in (1), the rotational-flow suppressing means is formed by combining a plurality of plate members, and provided inside of the guide ring.

(3) In the media-agitation type pulverizer set forth in (1) or (2), the media separation member is disposed within a cylindrical-shaped media-separation-member receiving chamber provided in the end plate and having a bottom formed as a downwardly-facing opening opened to the pulverization chamber, wherein the media-separation-member receiving chamber has a diameter greater than a diameter of the media separation member and less than a diameter of the pulverization chamber.

(4) In the media-agitation type pulverizer set forth in (3), the media-separation-member receiving chamber has a radius greater than a radius of the media separation member by 10 to 30 mm.

(5) In the media-agitation type pulverizer set forth in any one of (1) to (4), the media separation member comprises: a circular top plate; a circular bottom plate disposed in axially spaced-apart relation to the top plate, and a plurality of blade members disposed between the top plate and the bottom plate at intervals in a circumferential direction thereof.

(6) In the media-agitation type pulverizer set forth in (5), the media separation member is formed in a multistage structure in which an intermediate plate is provided between the top plate and the bottom plate.

(7) In the media-agitation type pulverizer set forth in any one of (1) to (6), the guide ring has a structure which is internally formed with an annular space, and supported by a plurality of pipes attached to the pulverization container, in such a manner as to allow liquid to be supplied and discharged to/from the annular space through the pipes.

(8) In the media-agitation type pulverizer set forth in (7), each of the pipes is disposed to extend downwardly from above the pulverization container and support the guide ring by a lower end thereof.

(9) The media-agitation type pulverizer set forth in any one of (3) to (8) further comprises media-flow regulation means disposed to surround the downwardly-facing opening of the end plate and adapted to restrict the pulverizing media in the pulverization chamber from flowing into the media-separation-member receiving chamber.

(10) In the media-agitation type pulverizer set forth in (9), the media-flow regulation means is composed of a downwardly-tapered truncated conical-shaped guide member having an internal space, wherein the guide member is adapted to change an upward flow of the mixture of the raw material slurry and the pulverizing media created by an action of the agitating member, to a downward flow.

(11) The media-agitation type pulverizer set forth in any one of (3) to (10) further comprises at least one protrusion provided on an inner peripheral wall of media-separation-member receiving means, wherein the protrusion has a flow passage extending in a circumferential direction of the guide member to allow the pulverizing media to pass therethrough.

(12) In the media-agitation type pulverizer set forth in (11), the protrusion is formed in a triangular shape having a base on the inner peripheral wall of the media-separation-member receiving means.

(13) In the media-agitation type pulverizer set forth in (11) or (12), the flow passage is provided in a base portion of the triangular-shaped protrusion on the media-separation-member receiving means.

(14) In the media-agitation type pulverizer set forth in any one of (1) to (13), the media separation member comprises: an approximately conical-shaped or truncated conical-shaped member body having a reduced-diameter distal end portion and an enlarged-diameter base portion; a transfer passage for the mixture, provided in the member body of the media separation member to extend from at least one inlet adjacent to the reduced-diameter distal end portion to an annular outlet in the enlarged-diameter base portion along a peripheral wall thereof, wherein the inlet is adapted to act as a mixture suction hole for sucking the mixture to allow it to flow into the transfer passage; a plurality of blade members provided in the transfer passage at positions adjacent to the annular outlet and arranged side-by-side along the annular outlet to perform a pulverizing-media pumping action; and a raw-material-slurry outlet passage branched from the transfer passage at a position upstream of the blade members.

(15) In the media-agitation type pulverizer set forth in any one of (1) to (13), the media separation member comprises: an approximately conical-shaped or truncated conical-shaped central member; and a generally hollow truncated conical-shaped outer member having an inner periphery located in spaced-apart relation to an outer periphery of the central member, wherein the transfer passage is formed by the space between the outer periphery of the central member and the inner periphery of the outer member.

(16) In the media-agitation type pulverizer set forth in (15), the outer member of the media separation member has a distal end fixed to a distal end of the central member of the media separation member.

(17) In the media-agitation type pulverizer set forth in (16), the distal end of the outer member of the media separation member is formed as a circular distal end plate, wherein the mixture suction hole is formed in the circular distal end plate.

Effect of the Invention

As described above, the media-agitation type pulverizer of the present invention is capable of controlling the helicoidal flow of the mixture of the pulverizing media and the raw material slurry to suppress a rotational flow in the circumferential direction of the pulverization chamber (i.e., primary flow) while strengthening the secondary flow (i.e., a circulation flow around the guide ring), thereby stabilizing the helicoidal flow. Thus, it becomes possible to facilitate uniformizing distribution of the pulverizing media in the flow to provide a flow having highly repetitive shear optimal to pulverization/dispersion with satisfactory energy efficiency.

In some cases, a satisfactory helicoidal flow is formed without employing the rotational-flow suppressing means as in the present invention. However, this is an accidental result in a situation where all conditions such as viscosity of the mixture are met, but a perfect helicoidal flow as in the present invention is not always formed.

DESCRIPTION OF EMBODIMENTS

With reference to the accompanying drawings, the present invention will now be described in connection with a media-agitation type pulverizer according to one embodiment thereof.

Figure 1:
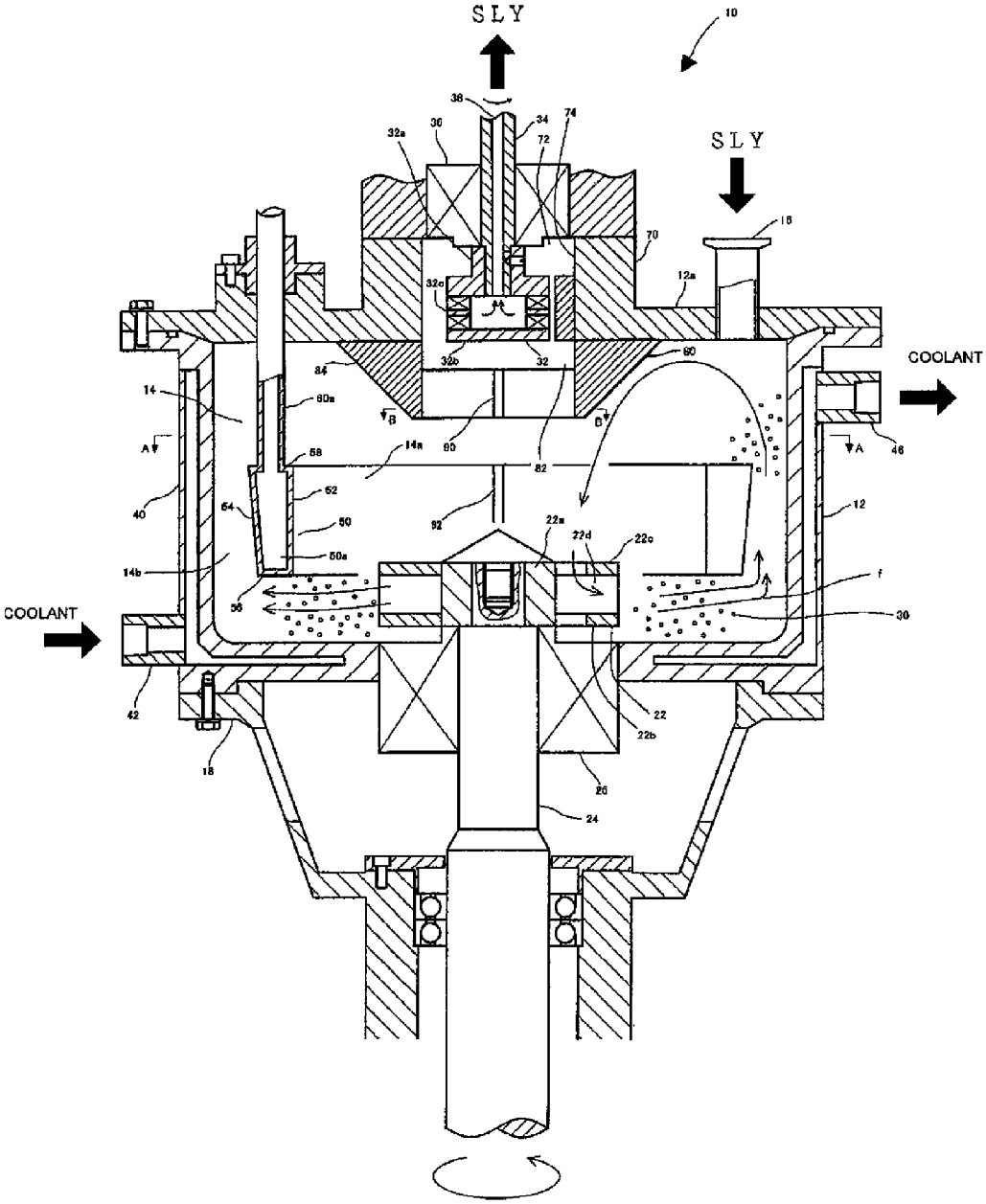
FIG. 1 is a sectional view illustrating a media-agitation type pulverizer according to one embodiment of the present invention.

FIG. 1 illustrates a media-agitation type pulverizer 10 according to one embodiment of the present invention. This media-agitation type pulverizer 10 comprises an upright cylindrical pulverization container 12 including an end plate 12*a* closing up an upper end thereof. The pulverization container 12 internally has a columnar pulverization chamber 14, and which is equipped therein with a raw-material-slurry supply port 16 for introducing a raw material in a slurry form (raw material slurry) into the pulverization chamber 14.

An agitating member 22 is rotatably disposed in the center of a bottom region of the pulverization chamber 14 of the pulverization container 12. The agitating member 22 is composed of an impeller which comprises, for example, a pair of annular plates 22*b*, 22*c* fixed to an outer periphery of a boss 22*a* in vertically spaced-apart relation to each other, and a plurality of blades 22*d* disposed between the plates 22*b* and 22*c*.

A rotary drive shaft 24 serving as an agitating-member driving shaft is fixed to the agitating member 22. The rotary drive shaft 24 has an upper end attached to the hub 22*a* of the agitating member 22 and extends axially downwardly to penetrate through the pulverization container 12 and a frame 18. A lower end of the rotary drive shaft 24 is connected to a driving source via a non-illustrated conventional driving mechanism to allow the rotary drive shaft 24 to be rotationally driven in the direction indicated by the arrow in FIG. 1. Preferably, the rotary drive shaft 24 has a rotation axis aligned with a central axis of the pulverization chamber 14. Further, the rotary drive shaft 24 is provided with a shaft seal 25 (e.g., a mechanical seal).

In place of the above centrifugal impeller, the agitating member 22 may be composed of an oblique-flow impeller.

As is well known in the field of media-agitation type pulverizers, pulverizing media 30 in the form of beads (which are illustrated in FIG. 1 in a significantly enlarged manner) are contained in the pulverization container 12. As the pulverizing media 30, it is possible to use a type having a diameter of 0.02 to 2 mm. A total volume of the pulverizing media 30 is in the range of 30% to 75% of a volume of the pulverization chamber 14. In a typical media-agitation type pulverizer, the total volume of the pulverizing media is in the range of 75% to 90% of the volume of the pulverization chamber. Thus, the media-agitation type pulverizer of the present invention is capable of performing soft pulverization/dispersion with less constraining force.

A centrifugal media separation member 32 is disposed in a top region of the pulverization chamber 14 of the pulverization container 12 and adjacent to the central portion of the pulverization chamber 14, in opposed and axially spaced-apart relation to the agitating member 22, and adapted to separate the pulverizing media 30 dispersed in the raw material slurry from the raw material. The media separation member 32 comprises: a boss 32*a* having a tubular boss body formed with an internal space in a lower portion thereof; and a closing plate 32*b* for closing up the lower portion of the boss body. The boss body of the boss 32*a* is provided with a plurality of openings, and the media separation member 32 is adapted to introduce only the raw material slurry into the internal space of the boss body through the openings. While it is preferable that the media separation member 32 is disposed in coaxial relation with the agitating member 22, the axes thereof may be offset from each other. A hollow rotary drive shaft 34 is fixed to that media separation member 32. The rotary drive shaft 34 extends upwardly to penetrate through the end plate 12*a*, and an upper end of the rotary drive shaft 34 is connected to a driving source via a non-illustrated conventional driving mechanism to allow the rotary drive shaft 34 to be rotationally driven in the direction indicated by the arrow in FIG. 1. Further, the rotary drive shaft 34 is provided with a shaft seal 36 (e.g., a mechanical seal). The hollow space of the rotary drive shaft 34 is communicated with the internal space of the media separation member 32 to form a raw-material-slurry exit 38. As the media separation member, a conventional screen may be used.

The centrifugal media separation member may have a configuration comprising: a circular top plate; a circular bottom plate disposed in axially spaced-apart relation to the top plate, and a plurality of blade members disposed between the top plate and the bottom plate at intervals in a circumferential direction thereof. Further, the media separation member may have also a multi-stage configuration wherein a circular intermediate plate 32*c* is provided between the top plate and the bottom plate.

A jacket 40 is provided around an outer periphery of the pulverization container 12 to allow a cooling or heating medium (typically, a cooling medium such as a coolant water) to flow therethrough so as to adjust an internal temperature of the pulverization chamber 14. This jacket 40 has a coolant water inlet 42 provided in a lower portion thereof to introduce a coolant water therethrough and a coolant water outlet 46 provided in an upper portion thereof to discharge the coolant water therefrom.

The end plate 12*a* is adapted to be detached to open the pulverization container 12, so that the pulverization container 12 can be readily subjected to maintenance.

In the media-agitation type pulverizer of the present invention, the agitating member 22 may be driven at a rotational circumferential speed ranging from 5 to 30 m/s, and the media separation member 32 may be driven at a rotational circumferential speed ranging from 10 to 20 m/s.

A guide ring 50 is disposed in a lower region of the pulverization chamber 14. This guide ring 50 comprises: an annular inner-peripheral plate 52; an annular outer-peripheral plate 54 disposed in spaced-apart relation to the inner-peripheral plate 52 in a radially outward direction; an annular lower plate 56 forming a bottom wall; and an annular upper plate 58 forming a top wall, and internally has a liquid-tight space.

The guide ring 50 is installed to radially divide the lower region of the pulverization chamber 14 into an inner section

14*a* and an annular outer section 14*b*. The inner section 14*a* of the lower region of the pulverization chamber 14 serves as an upward flow path for a mixture of the pulverizing media and the raw material slurry, and the outer section 14*b* of the lower region of the pulverization chamber 14 serves as an upward flow path for the mixture of the pulverizing media and the raw material slurry. Thus, in the pulverization chamber 14, a flow of the mixture of the pulverizing media and the raw material slurry is formed as a combined flow (i.e., helicoidal flow) consisting of a flow moving in a circumferential direction of the pulverization chamber (i.e., a primary flow) and a flow capable of regularly repeating a movement cycle of, after moving in the radially outward direction of the pulverization chamber toward an inner wall of the pulverization container, moving upwardly through the upward flow path between the guide ring and the pulverization container, and then moving downwardly from a central region of the pulverization chamber to return to the agitating member, via a space inward of the guide ring (i.e., a secondary flow). As mentioned above, this helicoidal flow has suffered from the problem of instability due to weakness of the secondary flow thereof.

Figure 2:
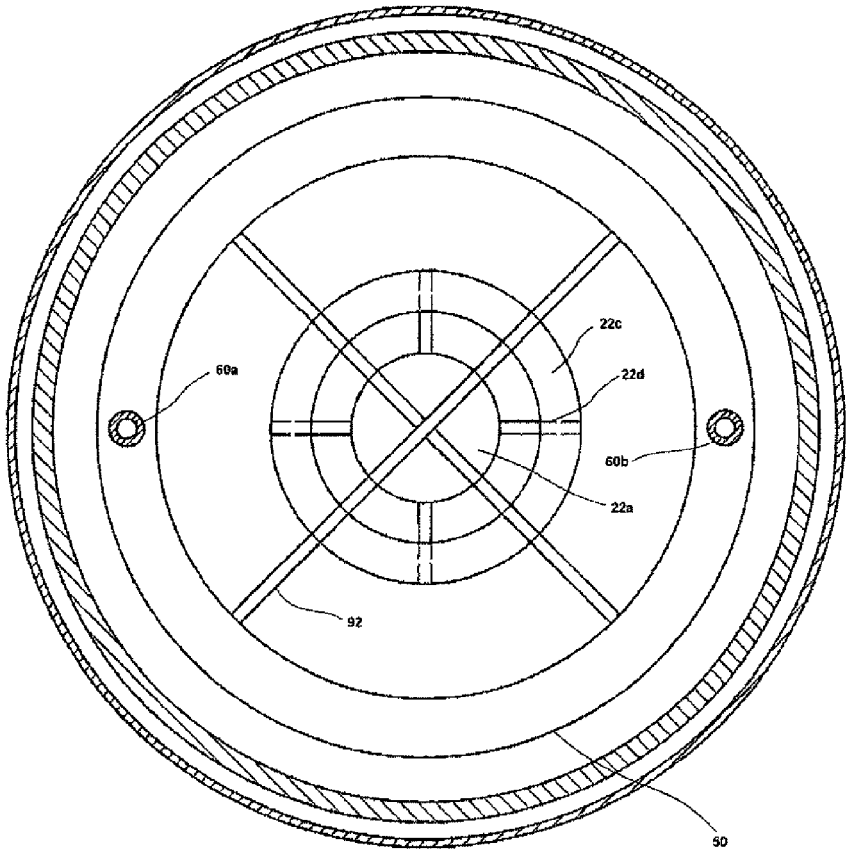
FIG. 2 is a sectional view taken along the line A-A in FIG. 1.
Figure 3:
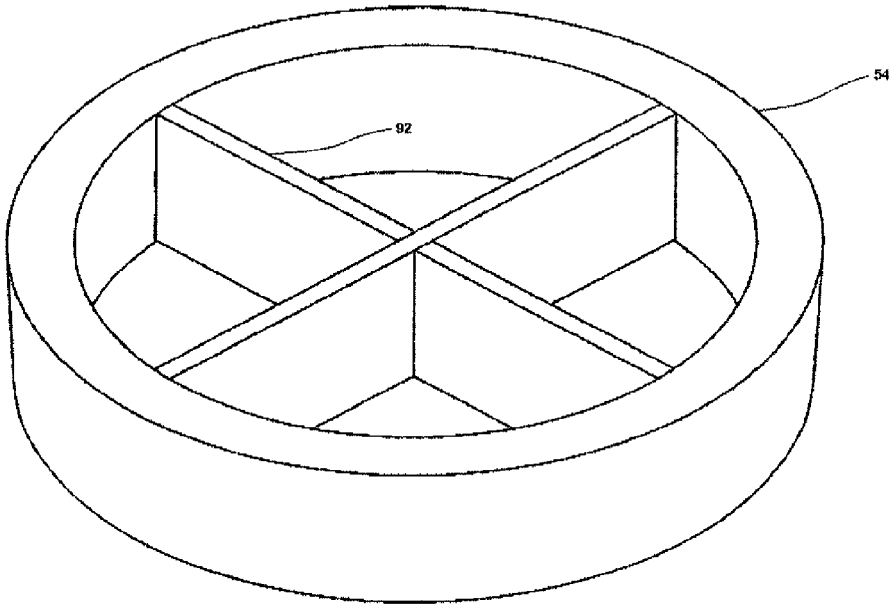
FIG. 3 is a perspective view schematically illustrating rotational-flow suppressing means.
Figure 4:
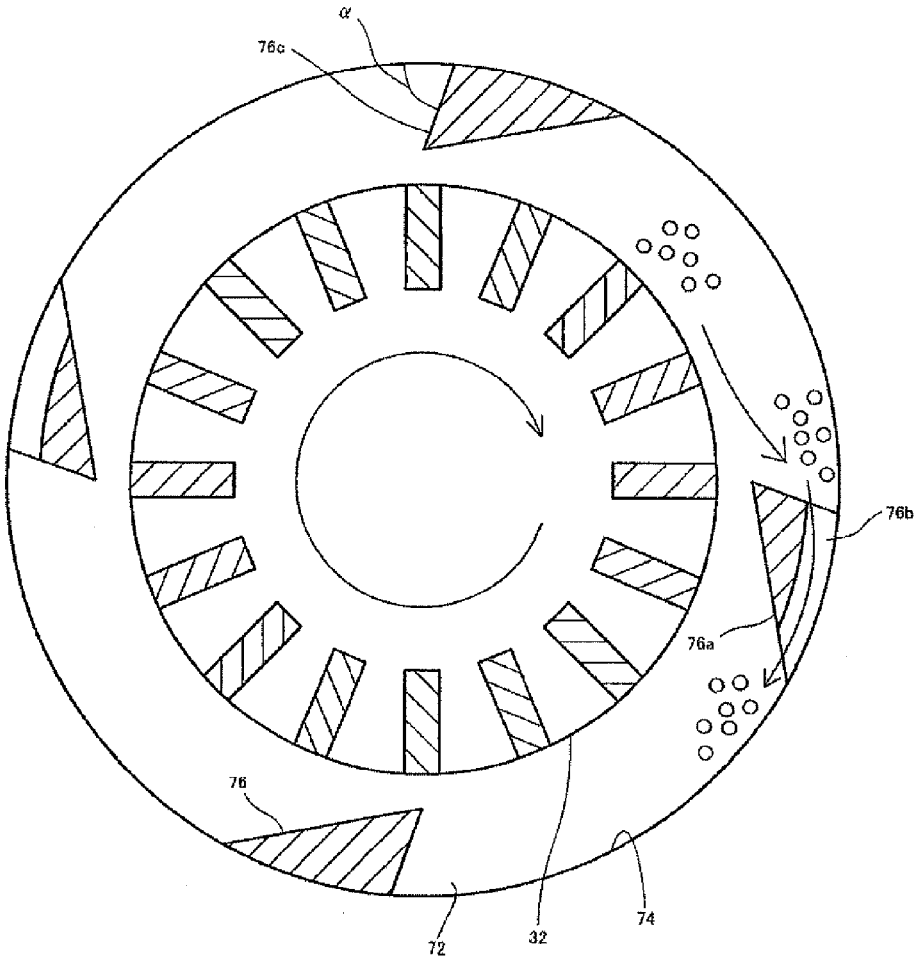
FIG. 4 is a horizontal sectional view illustrating an internal structure of a media-separation-member receiving chamber.

Further, a rotational-flow suppressing means 92 (see FIGS. 2 and 3) is provided in the inward space of the guide ring 50 to control the helicoidal flow of the mixture of the pulverizing media and the raw material slurry flowing axially downwardly through the inward space within the pulverization chamber 14, to suppress a rotational flow while strengthening the secondary flow. Preferably, the rotational-flow suppressing means 92 is formed in a cruciform shape by combining a plurality of plate members. The combined flow of the circumferential flow (primary flow) and the axial flow (secondary flow) created, mainly, by actions of the agitating member 22 and the guide ring 50, is controlled to strengthen the secondary flow by the newly provided rotational-flow suppressing means 92, thereby providing a stable helicoidal flow. This makes it possible to uniformize distribution of the pulverizing media contained in the combined flow and eliminate unevenness of a centrifugal force distribution to produce vigorous shearing forces between the pulverizing media, thereby further enhancing the function of the pulverizing media. A portion of the agitating member 22 located beneath the rotational-flow suppressing means 92 appears in FIG. 2. However, this is only for convenience of illustration, and the portion does not actually appear.

The guide ring 50 has a structure which is internally formed with an annular space 50*a*, as mentioned above, and supported by a plurality of pipes 60*a*, 60*b* (see FIG. 2) attached to the pulverization container, in such a manner as to allow a coolant water to be supplied and discharged to/from the annular space through the pipes 60*a*, 60*b*. Therefore, in the present invention, the raw material slurry can also be cooled from inside the pulverization container 12.

Preferably, each of the pipes 60*a*, 60*b* is disposed to extend downwardly from above the pulverization container 12 and support the guide ring 50 by a lower end thereof, as illustrated in FIG. 1.

Preferably, the guide ring 50 has a lower end located at a position equal to or higher than an upper end of the agitating member 22, and an upper end located at a position downwardly spaced apart from a lower end of the media separation member 32 by a predetermined distance, as illustrated in FIG. 1.

Preferably, a distance between an outer peripheral wall of the guide ring 50 and an inner peripheral wall of the pulverization container 12 is in the range of 10 to 50 mm. If the distance is less than the lower limit, movement of the beads will be excessively constrained. On the other hand, if the distance is greater than the upper limit, the freedom of the movement will be excessively increased.

Preferably, the guide ring 50 has a height which is ⅓ to ⅔ a height of the pulverization chamber. If the height is less than the lower limit, control of a bead flow will become insufficient. On the other hand, if the height is greater than the upper limit, smoothness of the bead flow will be impaired.

As illustrated in FIG. 1, a central portion of the end plate 12*a* is formed as a thick-walled portion 70 increased in thickness as compared with a surrounding portion (having a thickness greater than a height of the media separation member), and provided with a through-hole 72. The media separation member 32 is rotatably received in the through-hole 72, as illustrated in FIG. 1. In other words, the through-hole 72 serves as a media-separation-member receiving chamber or a media separation chamber, which receives therein the media separation member 32, and the thick-walled portion 70 serves as media-separation-member receiving means. In order to form the media-separation-member receiving chamber, the entirety of the end plate 12*a* may be formed to have a thickness equal to that of thick-walled portion 70. However, this is not a realistic way, because it leads to an increase in material cost and weight of the pulverizer.

Media-flow regulation means 80 is provided on a central region of a lower surface of the end plate 12*a* to restrict the pulverizing/dispersing media 30 in the pulverization chamber 14 from flowing into the media-separation-member receiving chamber. The media-flow regulation means 80 is composed of a downwardly-tapered truncated conical-shaped guide member which has a cylindrical space 82 penetrating therethrough in continuous relation to the through-hole 72, and an outer peripheral surface serving as a guide surface 84. This media-flow regulation means 80 also has a function of changing an upward flow of the mixture of the raw material slurry and the bead-form pulverizing media created by an action of the agitating member 22, to a downward flow along the guide surface 84, thereby eliminating factors causing instability in the mixture flow. Further, based on the controlled flow of the mixture of the raw material slurry and the pulverizing media, media freely flowing within the pulverization chamber 14 can be regulated as much as possible, so that it becomes possible to reduce a concentration of media around the media separation member 32, and restrict media from flying toward the media separation member 32, thereby enhancing a separation capacity of the media separation member.

Preferably, a rotational-flow suppressing means 90 (see FIG. 1) is provided in an internal space of the media-flow regulation means 80 to prevent turbulence in the mixture flow flowing from the pulverization chamber into the media-separation-member receiving chamber via the internal space. Preferably, the rotational-flow suppressing means 90 is formed in a cruciform shape by combining a plurality of plate members. Based on providing the rotational-flow suppressing means 90, it becomes possible to strengthen the secondary flow of the helicoidal flow of the mixture within the media-separation-member receiving chamber, thereby stabilizing the helicoidal flow to further enhance the function of the media separation member.

Figure 5:
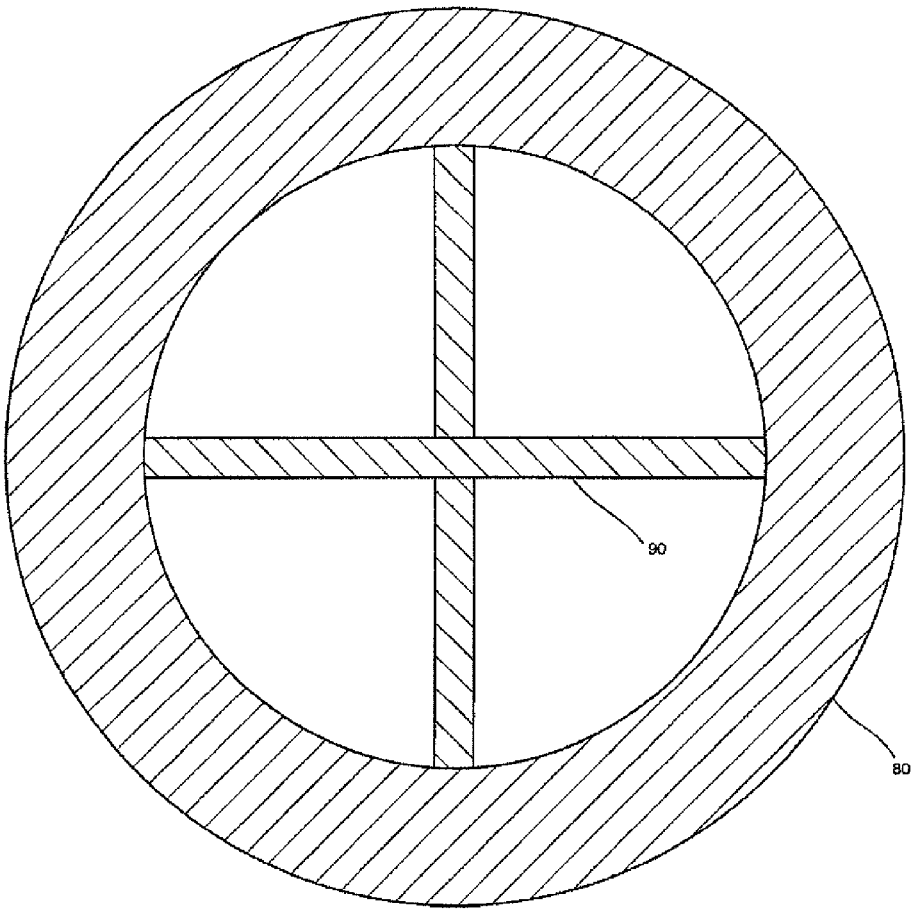
FIG. 5 is a sectional view taken along the line B-B in FIG. 1.

The media-separation-member receiving means (thick-walled portion 70) has an inner peripheral surface 74 provided with at least one, preferably a plurality of flow control protrusions 76 (see FIG. 5).

As illustrated in FIG. 5, the flow control protrusion 76 is formed in an approximately triangular shape having a base on the inner peripheral surface 74, in horizontal cross-section, and a media flow passage 76*b* is formed in a base portion (a portion adjacent to the base) 76*a* of the flow control protrusion 76. Preferably, an angle α defined between the inner peripheral surface 74 and one side 76*c* of the triangular flow control protrusion 76 having an inflow port of the media 30 i.e., opposed to the media flow, is set to an acute angle.

When the angle α is set to an acute angle, the opposed side 76*c* functions to direct the media toward the inner peripheral surface 74 of the media-separation-member receiving means (thick-walled portion 70), i.e., in a direction away from the media separation member 32, which is preferable in view of reducing a concentration of the media around the media separation member 32 to enhance a media separation function of the media separation member 32.

In the case where the angle α is set to an acute angle, the media are likely to stagnate in an acute-angled region. In this embodiment, the media flow passage 76*b* circumferentially penetrating through the base portion of the triangular flow control protrusion 76 is provided to allow the media to flow toward a downstream side via the media flow passage 76*b*, thereby preventing the media from stagnating in the acute-angled region.

A formation position of the media flow passage 76*b* may be changed depending on a height position of the flow control protrusion 76.

In the above embodiment, the thick-walled portion 70 is provided in the end plate 12, and the media-separation-member receiving chamber is provided in the thick-walled portion 70. Alternatively, an inside of the media-flow regulation means 80 may be formed as the media-separation-member receiving chamber.

In other words, the media-agitation type pulverizer may comprise media-separation-member receiving means provided with a media-separation-member receiving chamber receiving therein the media separation member and disposed on the lower surface of the end plate, wherein an outer peripheral surface of the media-separation-member receiving means is formed as media-flow regulation means adapted to restrict the pulverizing/dispersing media in the pulverization chamber from flowing into the media-separation-member receiving chamber.

In this case, the media-separation-member receiving means is composed of a downwardly-tapered truncated conical-shaped member having the cylindrical internal space, and disposed in a central region of the lower surface of the end plate, wherein an outer peripheral surface of the truncated conical-shaped member is formed to serve as a guide member adapted to change an upward flow of the mixture of the raw material slurry and the bead-form pulverizing/dispersing media created by the action of the agitating member, to a downward flow.

In this modification, at least one protrusion is provided on an inner peripheral wall of the above media-separation-member receiving means, and a flow passage is provided in the protrusion to extend in a circumferential direction of the guide member to allow the bead-form pulverizing/dispersing media to pass therethrough so as to create an outward flow of the media, as with the above embodiment.

During operation of the above media-agitation type pulverizer, the agitating member 22 is rotationally driven, while introducing the raw material slurry containing target particles as a raw material to be pulverized, into the pulverization chamber 14 through the raw-material-slurry supply port 16. The slurry introduced into the pulverization chamber 14 is moved downwardly toward the agitating member 22, with a rotational flow of the mixture of the slurry and the media 30 which has already been formed in the pulverization chamber 14, and then agitated and mixed with the mixture by the agitating member 22. In this process, the flow of the mixture of the raw material slurry and the pulverizing/dispersing media is controlled to strengthen the secondary flow by the rotational-flow suppressing means 92, and thereby formed as a stable helicoidal flow. Subsequently, the slurry and the media 30 are moved radially outwardly to the inner wall of the pulverization container 12. Then, the mixture of the slurry and the media 30 subjected to agitation and mixing is formed as a flow f moving upward through the upward flow path between the inner wall of the pulverization chamber 14 and the guide ring 50. When the flow moves fully upwardly, it is changed to the aforementioned downward flow.

Concurrently, in the media-separation-member receiving chamber, a rotational movement is given to the raw material slurry and the media by the media separation member 32. According to the rotational movement, the media having a relatively large mass are urged radially outwardly and separated from the slurry. In this process, a part of the target particles still having a relatively large particle size due to insufficient pulverization exhibit the same behavior as that of the media. On the other hand, the slurry containing particles sufficiently pulverized and reduced in mass are introduced into the internal space of the media separation member 32, and discharged to the outside of the media-agitation type pulverizer via the raw-material exit 38 inside the rotary drive shaft 34. Based on the above configuration, in the regulated flow, target particles as a raw material are subjected to good pulverization and dispersion by means of contact with the freely-moving pulverizing media, so that a high-quality product is obtained. In addition, based on the above functions, the media-agitation type pulverizer of the present invention can achieve pulverization providing a sufficiently narrow particle size distribution width. Furthermore, the media-agitation type pulverizer of the present invention requires a less amount of pulverizing media.

In the media-agitation type pulverizer of the present invention, the agitating member 22 is sufficiently spaced apart from the media separation member 32, so that a risk of interference with the media separation member 32 is extremely low.

Figure 6:
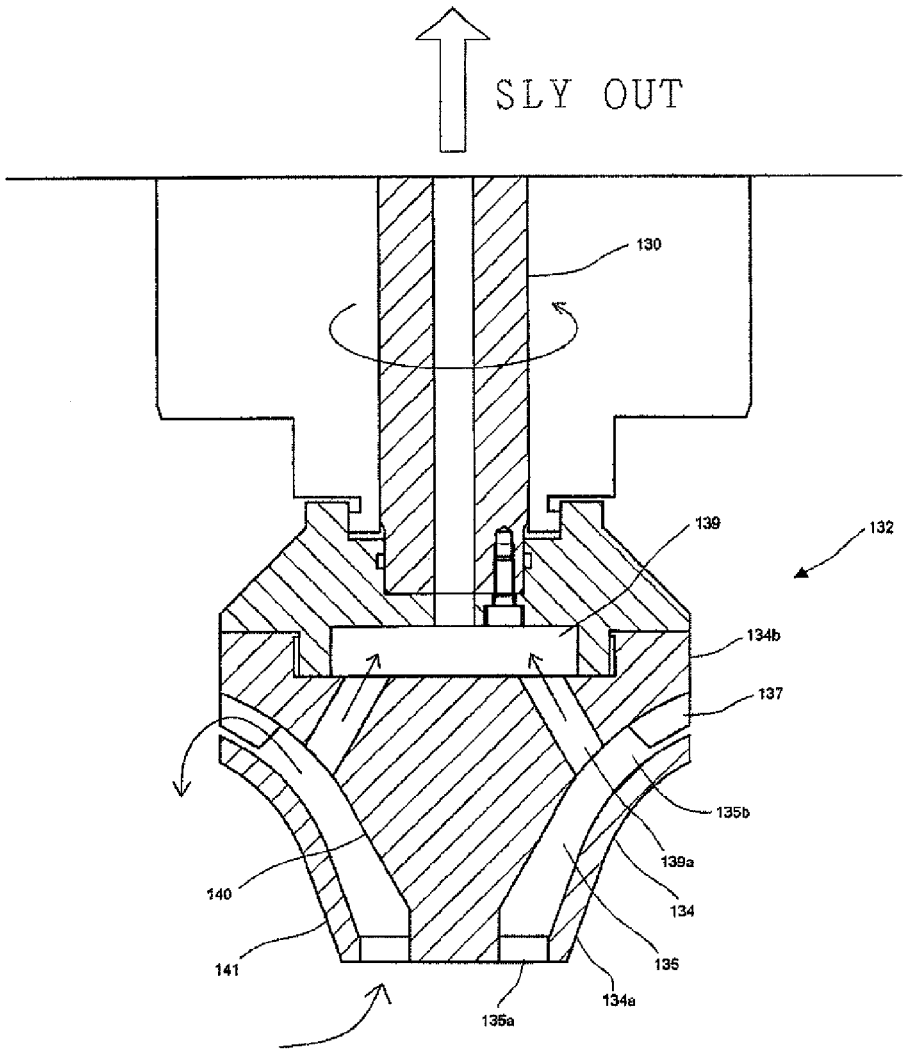
FIG. 6 is an enlarged sectional view illustrating an example of a modification of a centrifugal media separation member.
Figure 7:
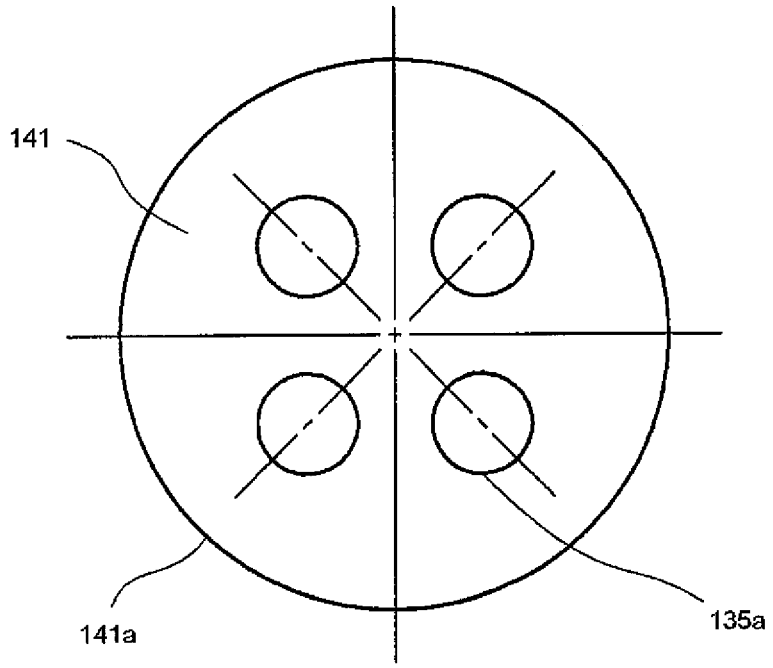
FIG. 7 is a bottom view of the centrifugal media separation member illustrated in FIG. 6.
Figure 8:
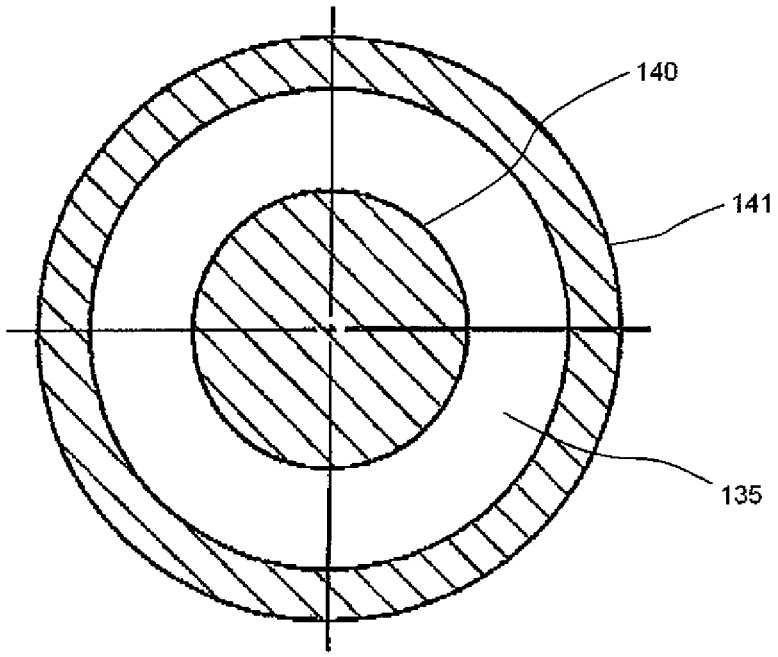
FIG. 8 is a horizontal sectional view of the centrifugal media separation member illustrated in FIG. 6, taken in the vicinity of a distal end thereof.

The media-agitation type pulverizer of the present invention may employ a centrifugal media separation member 132 as illustrated in FIGS. 6, 7 and 8. This centrifugal media separation member 132 comprises an approximately conical-shaped or truncated conical-shaped member body 134 having a reduced-diameter distal end portion 134*a* and an enlarged-diameter base portion 134*b*. A lower end of a drive shaft 130 is fixed to a center of the enlarged-diameter base portion 134*b* to allow the media separation member 132 to be rotated according to rotation of the drive shaft 130. A transfer passage 135 for the mixture is provided in the member body 134 to extend from at least one inlet 135*a* adjacent to the reduced-diameter distal end portion 134*a* to an annular outlet 135*b* in the enlarged-diameter base portion 134*b* along a peripheral wall thereof. The inlet 135*a* is adapted to act as a mixture suction hole for sucking the mixture to allow it to flow into the transfer passage 135. A plurality of blade members 137 are provided in the transfer passage 135 at positions adjacent to the annular outlet 135*b* and arranged side-by-side along the annular outlet to perform a media pumping action. Further, a raw-material-slurry outlet passage 139 is branched from the transfer passage 135 at a position upstream of the blade members 137.

The enlarged-diameter base portion 134*b* of the member body 134 is internally formed with a treated-raw-material-slurry collecting space 139 which is an approximately disk-shaped space, and the raw-material-slurry outlet passage 139*a* and a raw-material-slurry exit 131 are communicated with the treated-raw-material-slurry collecting space 139.

The member body 134 of the media separation member comprises an approximately conical-shaped or truncated conical-shaped central member 140, and a generally hollow truncated conical-shaped outer member 141 (see FIG. 8) having an inner periphery located in spaced-apart relation to an outer periphery of the central member 140. The transfer passage 135 is formed by the space between the outer periphery of the central member and the inner periphery of the outer member.

Preferably, the member body 134 is configured such that the outer member 141 has a distal end fixed to a distal end of the central member 140.

Specifically, the distal end of the outer member 141 is formed as a circular distal end plate 141*a* as illustrated in FIGS. 6 and 7, and the mixture suction hole (inlet 135*a*) is formed in the circular distal end plate 141*a*.

During the operation, the media are partially introduced into the media-separation-member receiving chamber. However, such media are separated from a treated-raw-material slurry and returned to the pulverization chamber again, by the media separation member 132 rotated within the media-separation-member receiving chamber, in the following manner.

Upon rotation of the media separation member 132, the blade members 137 provided in a region of the transfer passage 135 on the side of the enlarged-diameter base portion 134*b* of the member body 134 performs a pumping action. Primarily based on this pumping action, the slurry and others in the transfer passage 135 are ejected outside the transfer passage 135 through the outlet 135*b*. In conjunction with the ejection, a suction force is generated at the inlet 135*a* so that a flow of the slurry and others from the inlet 135*a* is created, and a rotational movement is given to the flow. According to the rotational movement, the relatively large and heavy media are urged radially outwardly and separated from the slurry. In this process, a part of the target particles still having a relatively large particle size due to insufficient pulverization exhibit the same behavior as that of the media. On the other hand, the slurry containing particles sufficiently pulverized and reduced in size and weight are discharged to the outside of the media-agitation type pulverizer via the raw-material-slurry outlet passage 139, the treated-raw-material-slurry collecting space 140 and the raw-material-slurry exit 131.

The media separation member has the above structure, so that it becomes possible to stabilize a flow of media-containing raw material slurry inside and around the media separation member to form a non-turbulent flow field, thereby performing satisfactory media separation.

Figure 9:
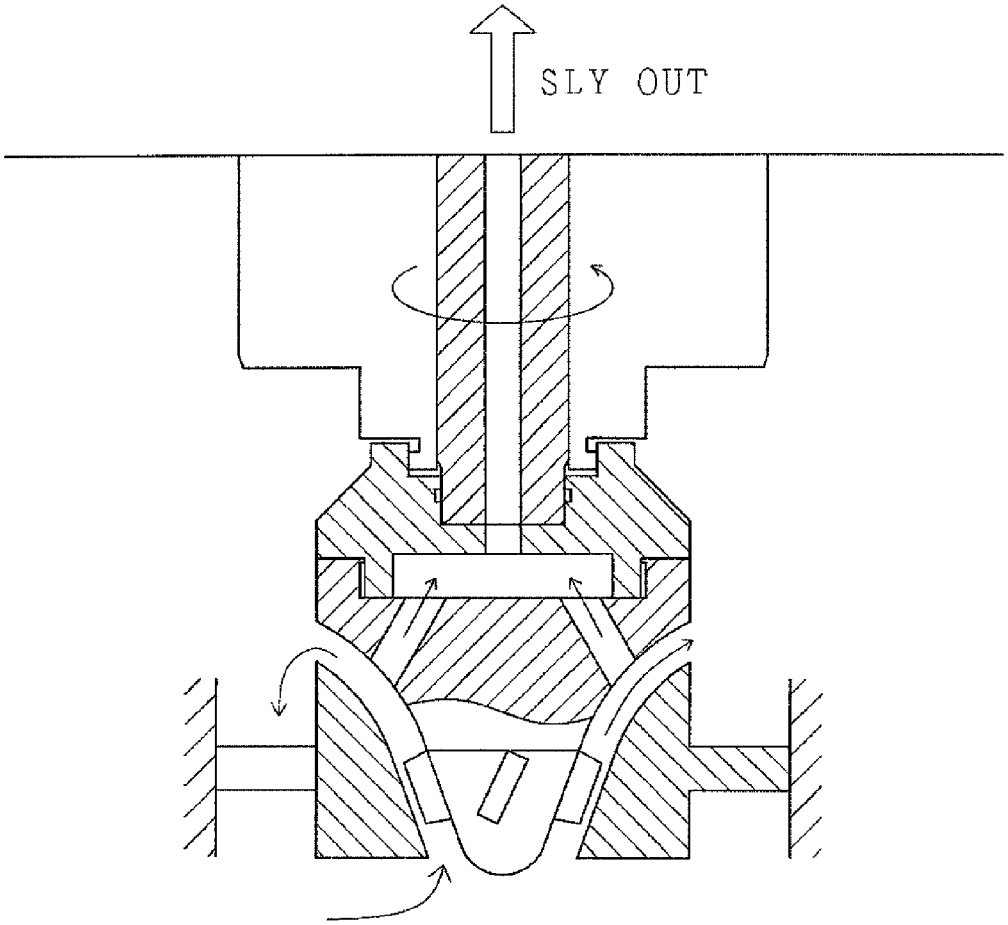
FIG. 9 is an enlarged sectional view illustrating another example of the modification of the centrifugal media separation member.

The media separation member illustrated in FIG. 6 and so forth has been described based on a structure configured to rotate the entire media separation member, i.e., a structure configured to rotate the central member together with the outer member. Alternatively, the media separation member may be configured such that only the central member is rotated, while fixing the outer member, as illustrated in FIG. 9.

EXPLANATION OF CODES

10: media-agitation type pulverizer
12: pulverization container
14: pulverization chamber
16: raw-material-slurry supply port
18: frame
22: agitating member
24: rotary drive shaft
25: shaft seal
30: pulverizing media
32: media separation member
32*a*: hub
32*b*: closing plate
34: hollow rotary drive shaft
36: shaft seal
38: raw-material-slurry outlet
40: jacket
40*a*: coolant inlet
40*b*: coolant outlet
50: guide ring
52: annular inner-peripheral plate
54: annular outer-peripheral plate
56: annular lower plate
58: annular upper plate
60*a*: pipe
60*b*: pipe
70: thick-walled portion (media-separation-member receiving means)
72: through-hole (media-separation-member receiving chamber)
74: inner periphery of media-separation-member receiving means (thick-walled portion 70)
76: protrusion
80: media-flow regulation means
82: cylindrical space
84: guide surface
90: flow straightening means
92: rotational-flow suppressing means

What is claimed is:

1. A media-agitation pulverizer comprising:

a pulverization container including an end plate closing up an upper end thereof and having an upright cylindrical pulverization chamber containing pulverizing media in the form of beads;

a raw-material-slurry supply port provided in the pulverization container;

an agitating member disposed in a bottom region of the pulverization chamber and having a rotary shaft substantially coaxial with a central axis of the pulverization chamber; and a media separation member provided within the pulverization chamber and above the agitating member, the media-agitation pulverizer being characterized in that it further comprises:

a guide ring installed to radially divide a lower region of the pulverization chamber into an inner section and an annular outer section, whereby a flow of a mixture of the raw material slurry and the pulverizing media is formed as a helicoidal flow comprising a combination of a primary flow flowing in a circumferential direction of the pulverization chamber and a secondary flow flowing through a circulation flow path which has an upward flow path and a downward flow path created, respectively, in the outer section and the inner section of the lower region of the pulverization chamber, with respect to the guide ring; and rotational-flow suppressing means provided within the pulverization chamber for controlling the helicoidal flow to suppress the primary flow while strengthening the secondary flow, thereby stabilizing the helicoidal flow, the rotational-flow suppressing means being formed in a cruciform shape, and provided in the guide ring, and the guide ring with the rotational-flow suppressing means being provided above the agitating member.

2. The media-agitation pulverizer as defined in claim 1, wherein the rotational-flow suppressing means is formed by combining a plurality of plate members, and provided inside the guide ring.

3. The media-agitation pulverizer as defined in claim 1, wherein the media separation member is disposed within a cylindrical-shaped media-separation-member receiving chamber formed in media-separation-member receiving means provided at the end plate, and having a bottom formed as a downwardly-facing opening opened to the pulverization chamber, wherein the media-separation-member receiving chamber has an inner diameter greater than an outer diameter of the media separation member and less than an inner diameter of the pulverization chamber.

4. The media-agitation pulverizer as defined in claim 3, wherein the media-separation-member receiving chamber has a radius greater than a radius of the media separation member by 10 to 30 mm.

5. The media-agitation pulverizer as defined in claim 1, wherein the media separation member comprises: a circular top plate; a circular bottom plate disposed in axially spaced-apart relation to the top plate, and a plurality of blade members disposed between the top plate and the bottom plate at intervals in a circumferential direction thereof.

6. The media-agitation pulverizer as defined in claim 5, wherein the media separation member is formed in a multi-stage structure in which an intermediate plate is provided between the top plate and the bottom plate.

7. The media-agitation pulverizer as defined in claim 1, wherein the guide ring has a structure which is internally formed with an annular space, and supported by a plurality of pipes attached to the pulverization container, in such a manner as to allow liquid to be supplied and discharged to/from the annular space through the pipes.

8. The media-agitation pulverizer as defined in claim 7, wherein each of the pipes is disposed to extend downwardly from above the pulverization container and support the guide ring by a lower end thereof.

9. The media-agitation pulverizer as defined in claim 3, which further comprises media-flow regulation means disposed to surround the downwardly-facing opening of the end plate and adapted to restrict the pulverizing media in the pulverization chamber from flowing into the media-separation-member receiving chamber.

10. The media-agitation pulverizer as defined in claim 9, wherein the media-flow regulation means is composed of a downwardly-tapered truncated conical-shaped guide member having an internal space, the guide member being adapted to change an upward flow of the mixture of the raw material slurry and the pulverizing media created by an action of the agitating member, to a downward flow.

11. The media-agitation pulverizer as defined in claim 3, which further comprises at least one protrusion provided on an inner peripheral wall of media-separation-member receiving means, wherein the protrusion has a flow passage extending in a circumferential direction of the guide member to allow the pulverizing media to pass therethrough.

12. The media-agitation pulverizer as defined in claim 11, wherein the protrusion is formed in a triangular shape having a base on the inner peripheral wall of the media-separation-member receiving means.

13. The media-agitation pulverizer as defined in claim 11, wherein the flow passage is provided in a base portion of the triangular-shaped protrusion of the media-separation-member receiving means.

14. The media-agitation pulverizer as defined in claim 1, wherein the media separation member comprises: an approximately conical-shaped or truncated conical-shaped member body having a reduced-diameter distal end portion and an enlarged-diameter base portion; a transfer passage for the mixture, provided in the member body of the media separation member to extend from at least one inlet adjacent to the reduced-diameter distal end portion to an annular outlet in the enlarged-diameter base portion along a peripheral wall thereof, the inlet being adapted to act as a mixture suction hole for sucking the mixture to allow it to flow into the transfer passage; a plurality of blade members provided in the transfer passage at positions adjacent to the annular outlet and arranged side-by-side along the annular outlet to perform a media pumping action; and a raw-material-slurry outlet passage branched from the transfer passage at a position upstream of the blade members.

15. The media-agitation pulverizer as defined in claim 1, wherein the media separation member comprises: an approximately conical-shaped or truncated conical-shaped central member; and a generally hollow truncated conical-shaped outer member having an inner periphery located in spaced-apart relation to an outer periphery of the central member, and wherein the transfer passage is formed by the space between the outer periphery of the central member and the inner periphery of the outer member.

16. The media-agitation pulverizer as defined in claim 15, wherein the outer member of the media separation member has a distal end fixed to a distal end of the central member of the media separation member.

17. The media-agitation pulverizer as defined in claim 16, wherein the distal end of the outer member of the media separation member is formed as a circular distal end plate, and wherein the mixture suction hole is formed in the circular distal end plate.

* * * * *